US008024821B2

(12) United States Patent
Chen

(10) Patent No.: US 8,024,821 B2
(45) Date of Patent: Sep. 27, 2011

(54) DETACHABLE CONNECTIVE DEVICE FOR TOILET SEAT

(76) Inventor: David Chen, Shengang Township, Changhua County (TW)

( * ) Notice: Subject to any disclaimer, the term of this patent is extended or adjusted under 35 U.S.C. 154(b) by 246 days.

(21) Appl. No.: 12/480,001

(22) Filed: Jun. 8, 2009

(65) Prior Publication Data

US 2010/0306909 A1 Dec. 9, 2010

(51) Int. Cl.
*A47K 13/12* (2006.01)

(52) U.S. Cl. ..... 4/236; 4/237; 4/240; 4/902; 4/239

(58) Field of Classification Search ..... 4/234–240, 4/902, 447, 444, 443, 420.1–420.5
See application file for complete search history.

(56) References Cited

U.S. PATENT DOCUMENTS

| | | | | |
|---|---|---|---|---|
| 4,964,179 | A * | 10/1990 | Kimes | 4/239 |
| 4,965,889 | A * | 10/1990 | Tissot et al. | 4/234 |
| 5,251,338 | A * | 10/1993 | Light | 4/235 |
| 5,608,921 | A * | 3/1997 | Barrett et al. | 4/239 |
| 5,666,672 | A * | 9/1997 | Birsel et al. | 4/236 |
| 6,381,762 | B1 * | 5/2002 | Moser | 4/240 |
| 6,418,566 | B1 * | 7/2002 | Plonta | 4/239 |
| 7,120,946 | B1 * | 10/2006 | Lazar | 4/420.4 |
| 7,161,118 | B1 * | 1/2007 | Modeste et al. | 219/217 |
| 7,712,157 | B2 * | 5/2010 | Laundre | 4/236 |
| 7,774,868 | B2 * | 8/2010 | Landsberger et al. | 4/237 |
| 2006/0218710 | A1 * | 10/2006 | Furukawa et al. | 4/237 |

FOREIGN PATENT DOCUMENTS

| | | | |
|---|---|---|---|
| EP | 1709896 | A2 * | 10/2006 |
| JP | 2004283214 | A * | 10/2004 |

* cited by examiner

*Primary Examiner* — Brian Glessner
*Assistant Examiner* — Beth Stephan
(74) *Attorney, Agent, or Firm* — Chung-Ming Shih

(57) ABSTRACT

A detachable connective device for toilet seat includes a base portion, a main body, a seat portion and a cover. The base portion is fitted under the main body, and the former may be detached from the latter. Therefore, the main body may be fitted to a toilet through the base portion. The seat portion is connected to the front end of the main body. A user may sit on the seat portion when using the toilet. The rear end of the cover is pivotally and coaxially connected with the main body so that the cover may rest on top of the seat portion. The base portion has two through apertures to allow fasteners to fixedly attach the base portion to the toilet. Therefore, the goal of easy installation may be achieved.

16 Claims, 5 Drawing Sheets

DETACHABLE CONNECTIVE DEVICE FOR TOILET SEAT

BACKGROUND OF THE INVENTION

1. Field of the Invention

The invention generally relates to a hygienic device. More particularly, the invention relates to a detachable connective device, which includes a base portion and a main body and may achieve the goal of easy installation.

2. Description of the Prior Art

Toilet seat with a detachable connective device has been known as hygienic or tissue less toilet seat. Such device is fitted onto a toilet and may spray water to clean up a user's anal and genital areas so that the user does not have to use tissue paper to wipe up these areas and such device may eliminate the discomfort generated by the use of tissue paper. In addition, the water may be pre-heated so as to enhance the comfort of the user.

Conventionally, the detachable connective device for toilet seat comprises a main body, an oval seat portion and a cover. The main body is connected with the toilet, and an electronic control unit is disposed inside the main body. The seat portion is connected to the front edge of the main body. A user may sit on the seat portion while using the toilet. The rear end of the cover is pivotally connected with the main body so as to allow the cover to rotate and to rest on top of the seat portion.

When the detachable connective device of the prior art is installed onto a toilet, the detachable connective device must be first placed on top of the toilet and then we have to use bolts to attach the main body to the rear portion of the toilet. Because of the volume and weight of the seat portion and the cover and the limited space in a restroom, the installation is relatively difficult.

From the above, we can see that the conventionally detachable connective device has many disadvantages and needs to be improved.

To eliminate the disadvantages of the detachable connective device of the prior art, the inventor has put in a lot of effort in the subject and has successfully come up with the detachable connective device of the present invention.

SUMMARY OF THE INVENTION

The object of the present invention is to provide a detachable connective device that includes a main body and a base portion. In installation, first, the base portion is fitted onto a toilet; then, the main body is fitted onto the base portion. Therefore, the goal of easy installation may be achieved.

To reach the object, the detachable connective device of the present invention is disclosed. The detachable connective device of the present invention comprises a base portion, a main body, a seat portion and a cover. The base portion is fitted under the main body, and the former may be detached from the latter. The seat portion is connected to the front end of the main body. A user may sit on the seat portion when using the toilet. The rear end of the cover is pivotally and coaxially connected with the main body so that the cover may rest on top of the seat portion. The base portion has two through apertures to allow fasteners to fixedly attach the base portion to the toilet. Therefore, the goal of easy installation may be achieved.

BRIEF DESCRIPTION OF THE DRAWINGS

The drawings disclose an illustrative embodiment of the present invention, which serves to exemplify the various advantages and objects hereof, and are as follows.

DETAILED DESCRIPTION OF THE PREFERRED EMBODIMENT

Figure 1:
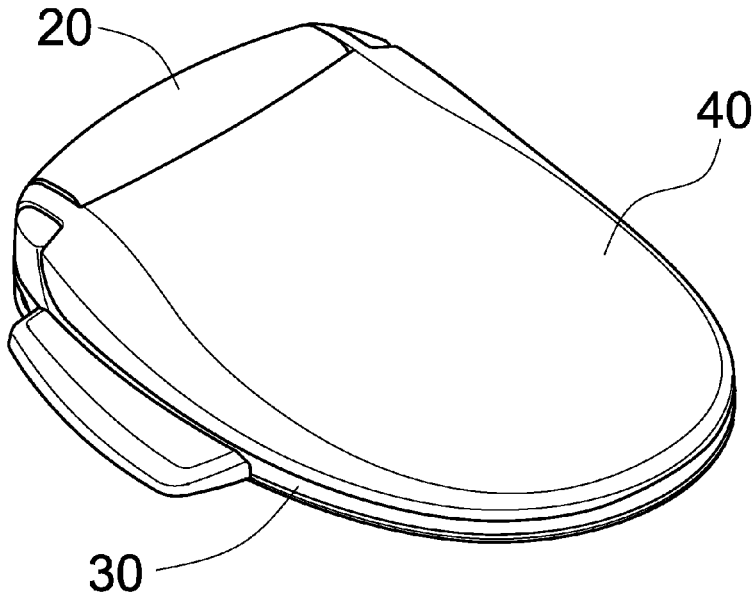
FIG. 1 is a perspective view showing the detachable connective device of the present invention.
Figure 2:
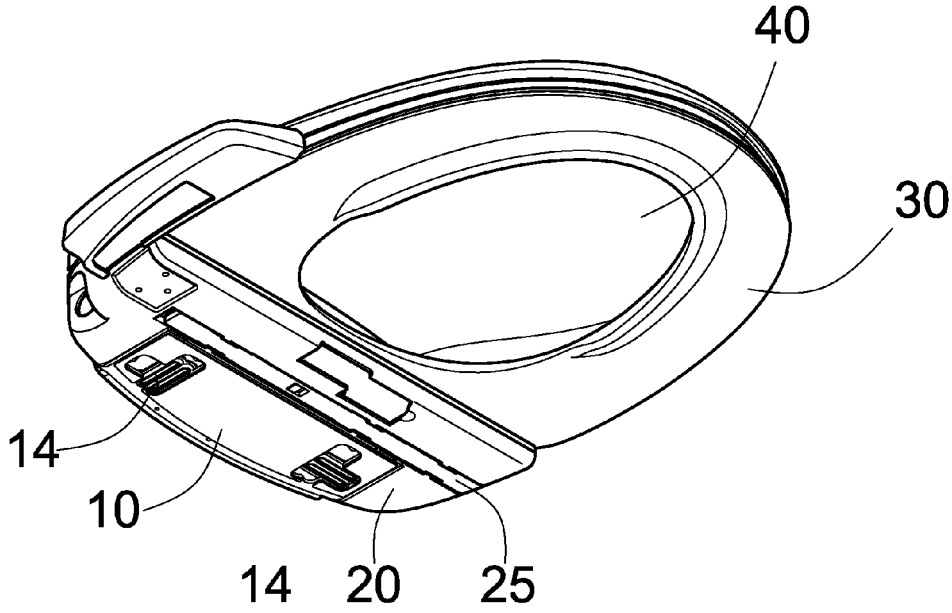
FIG. 2 is an oblique bottom view showing the detachable connective device of the present invention.
Figure 3:
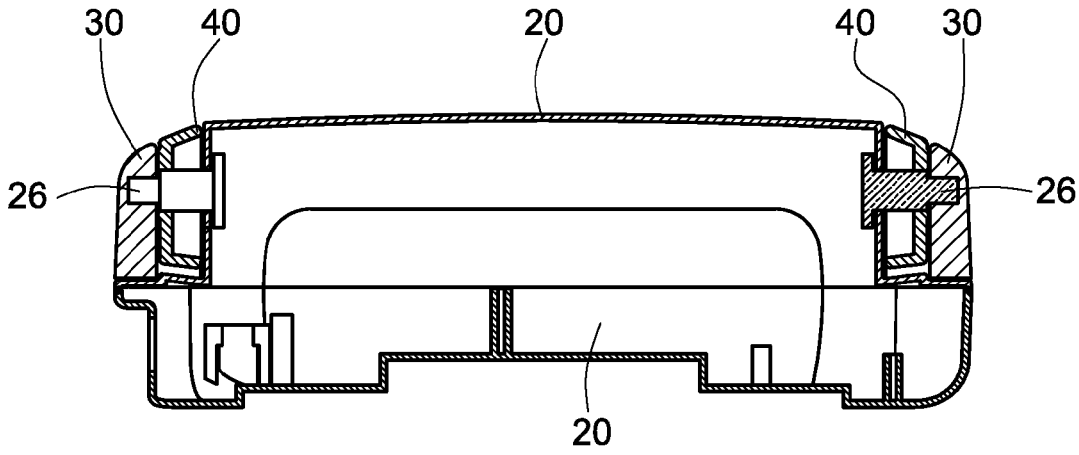
FIG. 3 is a cross-sectional view showing that the seat portion and the cover are pivotally and coaxially connected.

Please see FIGS. 1 and 2, which illustrate the first embodiment of the present invention. The detachable connective device of the present invention comprises a base portion 10, a main body 20, a seat portion 30 and a cover 40. The base portion 10 is first attached to a toilet, and then the main body 20 is affixed to the base portion 10. The seat portion 30 is connected to the front end of the main body 20. A user may sit on the seat portion 30 while using the toilet. The rear end of the cover 40 is connected with the main body 20. In addition, both the seat portion 30 and the cover 40 are pivotally and coaxially connected with the main body 20 through the pivot 26, as illustrated in FIG. 3. Therefore, the seat portion 30 may rotate around the main body 20; while the cover 40 may rotate around the seat portion 30 and may rest on top of the seat portion 30.

Figure 4:
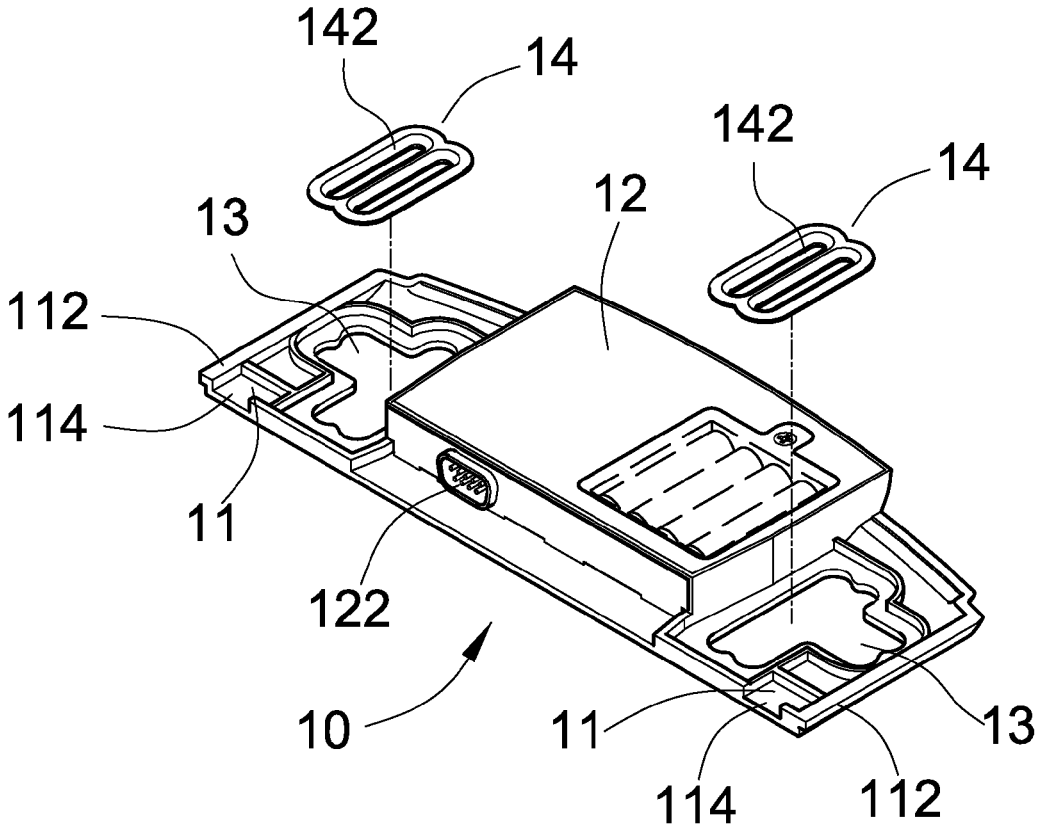
FIG. 4 is a perspective view showing the base portion of the detachable connective device of the present invention.
Figure 5:
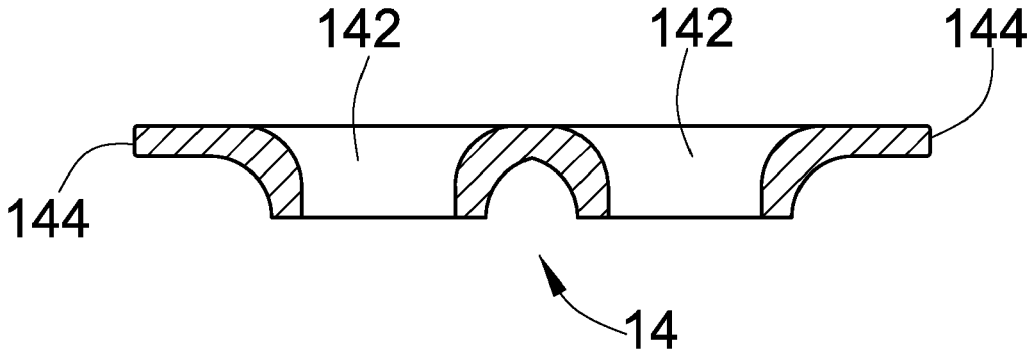
FIG. 5 is a cross-sectional view of one of the two positioning pieces of the detachable connective device of the present invention.
Figure 6:
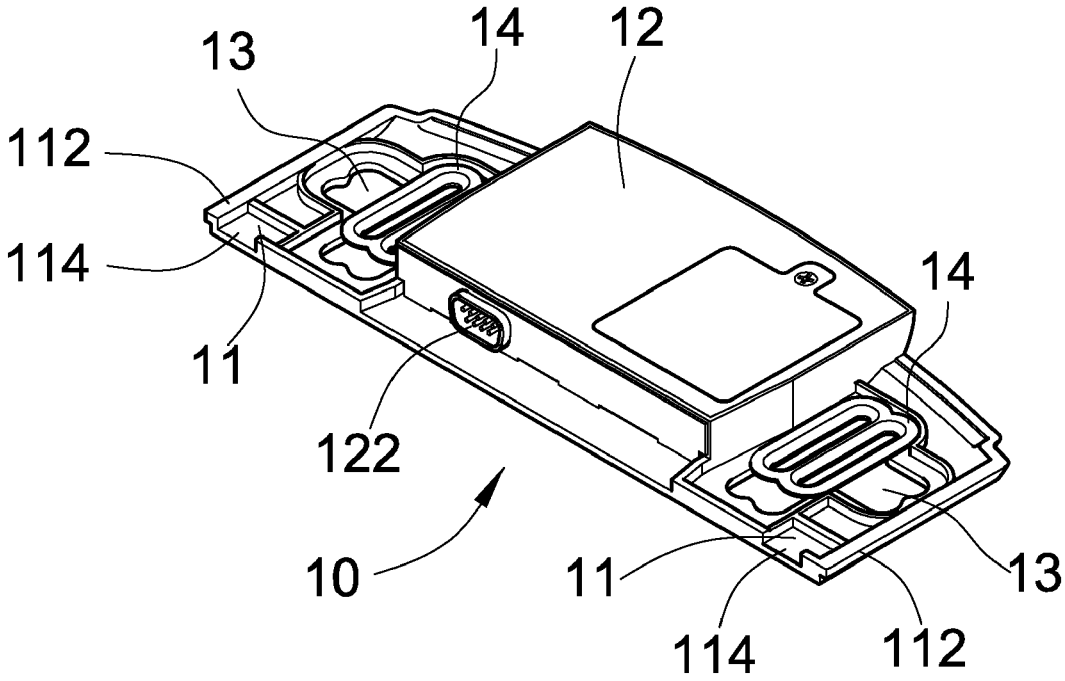
FIG. 6 is a perspective view showing that the two positioning pieces may be used longitudinally when the base portion is to be affixed to a toilet.
Figure 7:
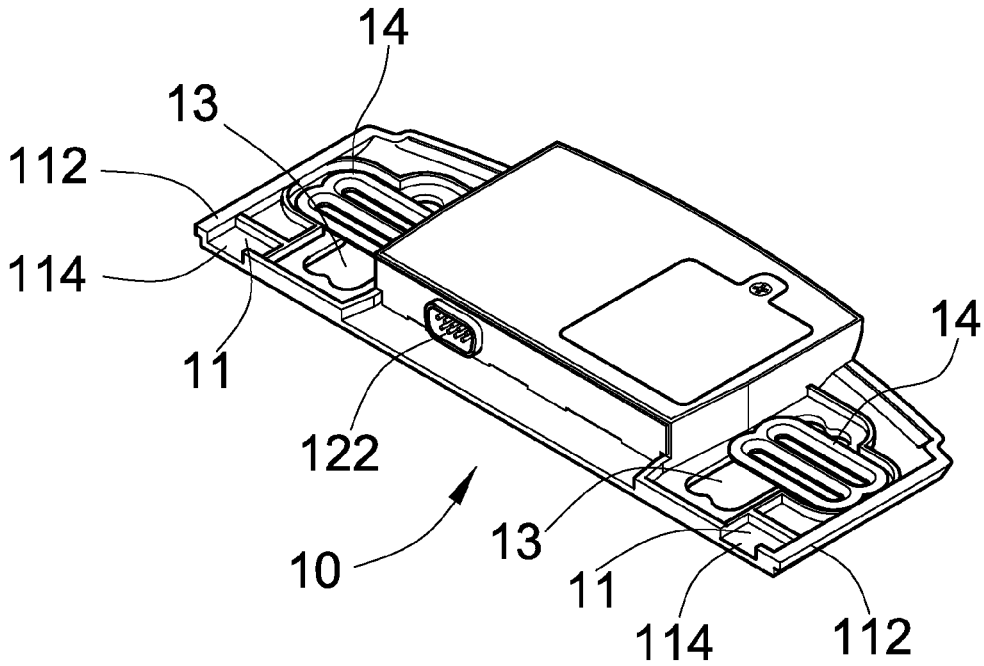
FIG. 7 is a perspective view showing that the two positioning pieces may be used laterally when the base portion is to be affixed to a toilet.

Now, please refer to FIG. 4. Two rectangular frames 11 are provided in the base portion 10, and a box 12 is disposed between the two frames 11. An engagement strip 112 extends from the sidewall of the either rectangular frames 11. An engagement notch 114 is provided in the front wall of each of the two rectangular frames 11 so as to allow the connection between the main body 20 and the base portion 10. Two through apertures 13 are formed in the base portion 10. The longer axis of either of the two apertures 13 is longitudinally oriented, and the shorter axis of either of the two apertures 13 is laterally oriented. Two positioning pieces 14 are provided. Two parallel rectangular through slots 142 are provided in each of the two positioning pieces 14, as illustrated in FIG. 5. A protruding edge 144 is formed on each positioning piece 14. Each of the two positioning pieces 14 may be engaged with the corresponding aperture 13, and each protruding edge 144 may rest on the peripheral portion of the aperture 13. Therefore, bolts (not shown in the drawings) or other types of fasteners may be used to attach the base portion 10 to the toilet by passing through the slots 142 of the position pieces 14 and the aperture 13. In installation, as illustrated in FIG. 6 or FIG. 7, when the base portion 10 is affixed to a toilet, either positioning piece 14 may be used longitudinally (as illustrated in FIG. 6) or laterally (as illustrated in FIG. 7) on top of the corresponding aperture 13 according to the locations of the pre-formed holes in the toilet. In addition, either positioning piece 14 may be moved around on top of the corresponding aperture 13; therefore, this makes the installation easier.

Figure 8:
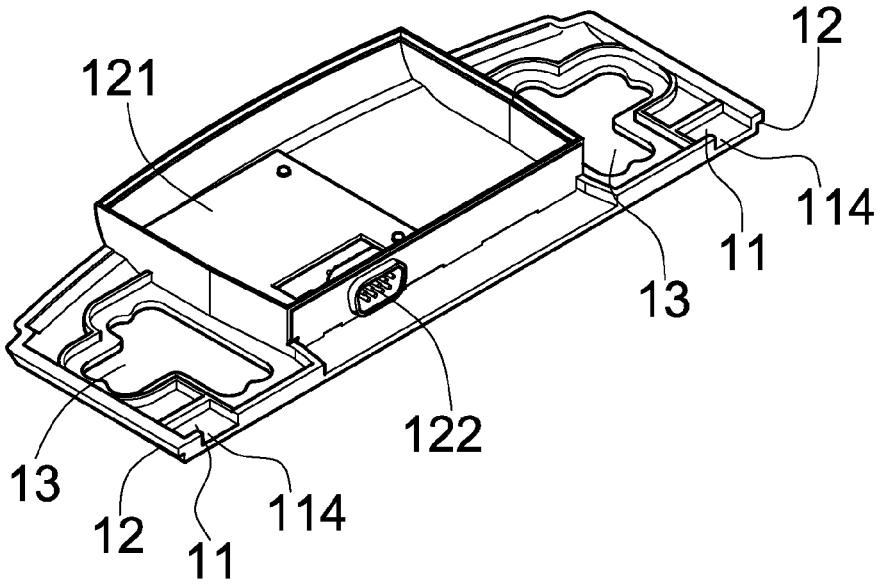
FIG. 8 is a perspective view schematically illustrating the internal structure of the box of the base portion.

As illustrated in FIG. 8, an electronic memory unit 121 is disposed in the box 12. An electrical connective device 122, which is electrically connected with the electronic memory unit 121, is disposed on the front side of the box 12.

Figure 9:
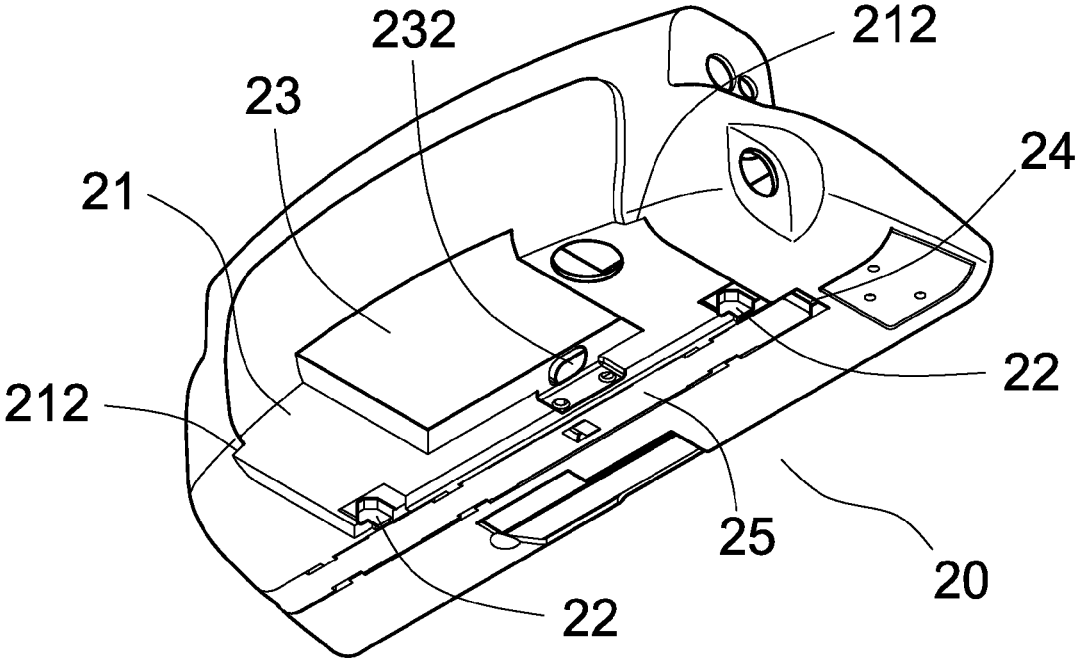
FIG. 9 is an oblique bottom view showing the main body of the detachable connective device of the present invention.

As illustrated in FIG. 9, a rectangular cavity 21 is provided on the underside of the main body 20, and an engagement protrusion 212 is provided on either of the two walls of the cavity 21. Therefore, each of the two engagement strips 112 of the base portion 10 may engage with the corresponding engagement protrusion 212 and the base portion 10 may be vertically fixed in the cavity 21. Two engagement hooks 22 protrude from the front edge of the cavity 21 of the main body 20. Each engagement hook 22 may engage with the corresponding engagement notch 114 and hence the two frames 11 may be fixed. Therefore, the base portion 10 may be horizontally fixed in the cavity 21.

A second cavity 23 is formed in the central portion of the cavity 21 of the main body 20 to receive the box 12. A hole 232 is provided in the front wall of the second cavity 23 to receive the electrical connective device 122. Therefore, the electronic memory unit 121 may be electrically connected with the electronic circuit located in the main body 20.

Figure 10:
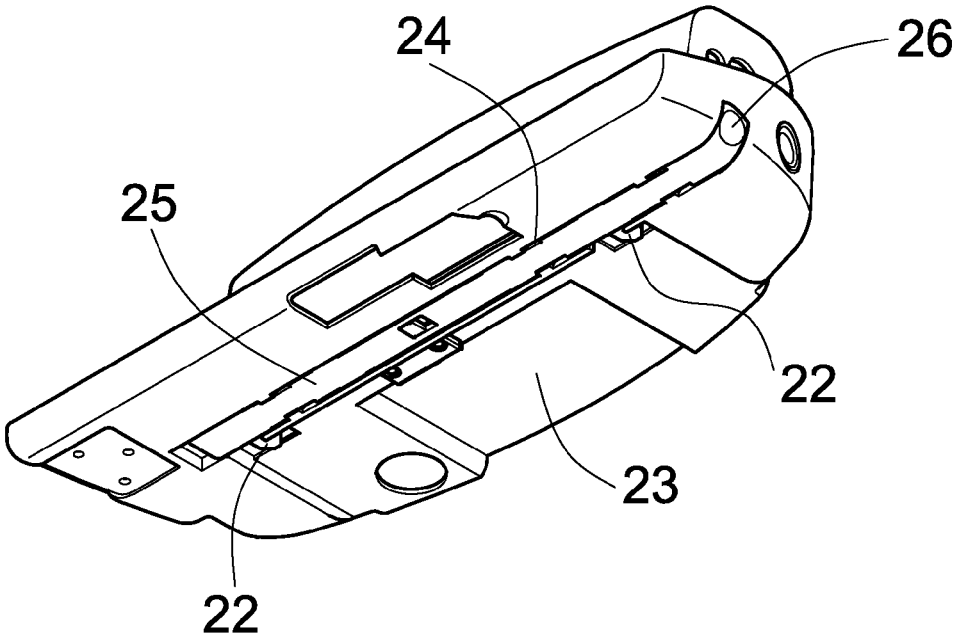
FIG. 10 is another oblique bottom view showing the main body of the detachable connective device of the present invention.

Please refer to FIGS. 9 and 10 now. An elongated rectangular slot 24 is laterally formed near the cavity 21. A sliding piece 25 is fitted onto the slot 24. Therefore, the sliding piece 25 may slide along in the slot 24. A disengagement element 26 is formed at one end of the sliding piece 25. A user may press the disengagement element 26 and then slide the sliding piece 25 along in the slot 24 to disengage each engagement hook 22 from the corresponding notch 114 and hence to separate the main body 20 from the base portion 10.

As previously described, the detachable connective device of the present invention includes a base portion 10 and a main body 20. In installation, first, press the disengagement element 26 and then slide the sliding piece 25 along in the slot 24 to disengage each engagement hook 22 from the corresponding notch 114. Now, the main body 20 may be separated from the base portion 10. Next, we can easily fit the compact, lightweight base portion 10 onto a toilet by adjusting the positions of the two positioning pieces and the base portion 10 regardless of the small space in the restroom. Therefore, the installation is quite easy. Then, place the main body 20 along with the seat portion 30 and the cover 40 on top of the toilet and slide each of the two-engagement protrusion 212 of the main body 20 along the corresponding engagement strip 112 of the base portion 10. Now, the main body 20 is laterally fixed down. Also, the two engagement hooks 22 longitudinally fix the main body 20 down. Now, the installation is completed.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A detachable connective device, comprising:

a main body;

a base portion, which is disposed under the main body, being detached from the main body and assisting fitting of the main body to a toilet;

a seat portion, which is connected to the front end of the main body and on which a user may sit on when using the toilet; and a cover, whose rear end is connected with the main body and which rests on top of the seat portion, wherein a rectangular cavity is provided on an underside of the main body to receive the base portion, wherein a box is disposed on the base portion and a second cavity is formed in the central portion of the cavity of the main body to receive the box, and wherein the base portion has two apertures and two fasteners are used to connect the base portion with the toilet by passing through the aperture, respectively, so that the base portion is fitted onto the toilet and a goal of easy installation is achieved.

2. The detachable connective device as in claim 1, wherein the seat portion and the cover are pivotally and coaxially connected with the main body.

3. The detachable connective device as in claim 1, wherein an engagement protrusion is provided on either of the two walls of the cavity and the base portion is vertically held and fixed in the cavity of the main body.

4. The detachable connective device as in claim 3, wherein an engagement strip extends from the side wall of either of two rectangular frames and is engaged with the corresponding engagement protrusion of the main body so as to assist a linkage between the base portion and the main body.

5. The detachable connective device as in claim 4, wherein the two rectangular frames are provided in the base portion and the engagement strip extends from the side wall of either of the two rectangular frames.

6. The detachable connective device as in claim 1, wherein an electronic memory unit is disposed in the box.

7. The detachable connective device as in claim 6, wherein an electrical connective device, which is electrically connected with the electronic memory unit, is disposed on a front side of the box and a hole is provided in a front wall of the second cavity to receive the electrical connective device and the electronic memory unit is electrically connected with the electronic circuit located in the main body.

8. The detachable connective device as in claim 1, wherein a longer axis of the aperture is oriented longitudinally so that the base portion is easily fitted to the toilet through alignment of the aperture and a pre-formed hole of the toilet and the goal of easy installation is achieved.

9. The detachable connective device as in claim 8, wherein the two apertures are formed in the base portion and the shorter axis of either of the two apertures is laterally oriented so as to make the installation easier.

10. A detachable connective device, comprising:

a main body;

a base portion having two apertures, which is disposed under the main body, being detached from the main body and assisting fitting of the main body to a toilet;

a seat portion, which is connected to the front end of the main body and on which a user may sit on when using the toilet; and a cover, whose rear end is connected with the main body and which rests on top of the seat portion, wherein a rectangular cavity is provided on an underside of the main body to receive the base portion, wherein two engagement hooks protrude from a front edge of the cavity of the main body, an engagement notch is provided in a front wall of each of the two rectangular frames and each engagement hook engages with the corresponding engagement notch of the base portion so that the base portion is horizontally fixed in the cavity of the main body, and wherein the two engagement hooks are connected with a sliding piece and a user slides the sliding piece to disengage the two engagement hooks from the notches so as to separate the main body from the base portion.

11. The detachable connective device as in claim 10, wherein a disengagement element is formed at one end of the sliding piece and a user presses the disengagement element and then slides the sliding piece.

12. The detachable connective device as in claim 10, wherein an elongated rectangular slot is laterally formed near the cavity of the main body and the sliding piece slides along in the elongated rectangular slot.

13. A detachable connective device, comprising:

a main body;

a base portion having two apertures, which is disposed under the main body, being detached from the main body and assisting fitting of the main body to a toilet;

a seat portion, which is connected to the front end of the main body and on which a user may sit on when using the toilet; and a cover, whose rear end is connected with the main body and which rests on top of the seat portion, wherein a longer axis of the aperture is oriented longitudinally so that the base portion is easily fitted to the toilet through alignment of the aperture and a pre-formed hole of the toilet, and wherein two positioning pieces are placed on top of the rectangular frames and each fastener is used to fit the base portion to the toilet by passing through the positioning piece, the aperture and one of the pre-formed holes of the toilet.

14. The detachable connective device as in claim 13, wherein two rectangular through slots are provided on each of the two positioning pieces so as to allow an adjustment of the location of the base portion according to the locations of the pre-formed holes of the toilet and so that the goal of easy installation may be achieved.

15. The detachable connective device as in claim 13, wherein two parallel rectangular through slots are provided in each of the two positioning pieces.

16. The detachable connective device as in claim 13, wherein a protruding edge is formed on each of the two positioning pieces and each protruding edge rests on the peripheral portion of the corresponding aperture so that each of the two positioning pieces rests on the corresponding aperture.

* * * * *